US011879714B2

(12) United States Patent
Sprenger

(10) Patent No.: US 11,879,714 B2
(45) Date of Patent: Jan. 23, 2024

(54) FIREARM CARTRIDGE CASE

(71) Applicant: Matthew Sprenger, Elgin, ND (US)

(72) Inventor: Matthew Sprenger, Elgin, ND (US)

( * ) Notice: Subject to any disclaimer, the term of this patent is extended or adjusted under 35 U.S.C. 154(b) by 0 days.

(21) Appl. No.: 17/938,728

(22) Filed: Oct. 7, 2022

(65) Prior Publication Data

US 2023/0280137 A1 Sep. 7, 2023

Related U.S. Application Data

(60) Provisional application No. 63/315,305, filed on Mar. 1, 2022.

(51) Int. Cl.
*F42B 5/26* (2006.01)

(52) U.S. Cl.
CPC ..... *F42B 5/26* (2013.01)

(58) Field of Classification Search
None
See application file for complete search history.

(56) References Cited

U.S. PATENT DOCUMENTS

| | | | | |
|---|---|---|---|---|
| 4,095,363 | A | 6/1978 | Riedl | |
| 5,970,879 | A | 10/1999 | Jamison | |
| 6,354,221 | B1 | 3/2002 | Jamison | |
| 7,047,686 | B2 | 5/2006 | Zimmermann | |
| 7,243,453 | B2 | 7/2007 | McGarry | |
| 7,305,786 | B2 | 12/2007 | McGarry | |
| 7,318,294 | B2 | 1/2008 | Zimmermann | |
| 7,360,331 | B2 | 4/2008 | McGarry | |
| 7,581,345 | B2 | 9/2009 | McGarry | |
| 8,356,543 | B2 | 1/2013 | Rosol et al. | |
| 8,443,729 | B2 | 5/2013 | Mittelstaedt | |
| 10,240,882 | B1 | 3/2019 | Hoffman | |
| 10,274,271 | B2 | 4/2019 | Cozzo et al. | |
| 10,571,232 | B1 | 2/2020 | Hoffman | |
| 10,866,072 | B2 | 12/2020 | Imhoff et al. | |
| 10,907,918 | B2 | 2/2021 | Curry | |
| 11,067,370 | B2 | 7/2021 | Imhoff et al. | |
| 11,268,791 | B1 | 3/2022 | Frees et al. | |
| 2011/0214583 | A1* | 9/2011 | Dutch | F42B 5/26 102/464 |

* cited by examiner

*Primary Examiner* — Reginald S Tillman, Jr.

(74) *Attorney, Agent, or Firm* — Fargo Patent & Business Law; Thomas Kading

(57) ABSTRACT

A firearm cartridge case includes a cartridge case having a base which defines a cartridge case diameter; and a rebated rim which defines a rim diameter less than the cartridge case diameter, a ratio of the cartridge case diameter to the rim diameter is between 1.03-1.10.

24 Claims, 2 Drawing Sheets

FIREARM CARTRIDGE CASE

The present disclosure claims priority to U.S. Provisional Patent Disclosure Ser. No. 63/315,305 filed Mar. 1, 2022.

BACKGROUND

This disclosure generally relates to small arms ammunition and more specifically to a centerfire cartridge case.

Firearm cartridges are available in a wide range of variations for different applications. However, the variations are not infinite, and there are important constraints on cartridge dimensions. A typical rifle cartridge has a bottleneck shape with a slightly tapered main body portion extending from a base or head end to a tapered frusto-conical shoulder that transitions to a nearly cylindrical neck to receive a projectile.

While cartridges may exist in any theoretical dimension, typical cartridges are limited in their dimensions due to the characteristics of gun powder and structural limitations of firearm actions which define the chamber within which the cartridge is received. In addition, most cartridges are members of a family in which each member of the family is a variation from a common parent cartridge. While cartridges outside of established families with established case head dimensions are theoretically possible, there are economic barriers due to the large tooling cost for a new cartridge.

Cartridge dimensions are also generally restricted to the dimensions of the actions of the firearms which are generally produced in but a few size categories. The action of a firearm typically includes an opening rearward of the chamber through which a cartridge is received that has a length that limits the cartridge overall length.

As it may be disadvantageous to employ an action significantly longer than that for the desired cartridge, there are typically only a limited number of action lengths. A "magnum" length action accepts cartridges that are over 3.34 inches in length with most cartridges being about 3.6 inches long. The 375 H&H magnum is a well-known example. A "long/standard" length action accepts cartridges that are over 2.8 inches in length but under 3.34 inches. The 30-06 is a well-known example. A "short" length action accepts cartridges that are under 2.8 inches in length and generally any cartridge over about 2.3 inches. The 308 Winchester is a well-known example and the most popular short action cartridge on the market. A 'mini' length action accepts cartridges that are below 2.3 inches in length. The 5.56×45 NATO and its civilian equivalent, the 223 Remington is a well-known example.

The width of the action opening also limits the diameter of the accepted cartridge. Typical actions are also provided in standard widths. A "super magnum" width action typically admits a cartridge with a maximum diameter of 0.580 inch. This is sized to closely accommodate the 378 and 460 Weatherby which are super magnum length belted cartridges, for instance. A "magnum" width action typically admits a cartridge with a maximum diameter of 0.538 inch. This is sized to closely accommodate the 350 Remington Magnum which is a short-action belted cartridge; the 6.5 mm Remington Magnum which is a short-action belted cartridge; the 300 Winchester Magnum which is a long-action belted cartridge; the 7 mm Remington Magnum which is a long-action belted cartridge; and the 375 Magnum which is a magnum-length-action belted cartridge. A "Long/standard" width action typically admits a cartridge with a maximum diameter of 0.471 inches. This is sized to closely accommodate the 308 Winchester, and the 30-06 Springfield cartridges, for instance.

The shooting and hunting industry have traditionally been accustomed to choosing either a small standard cartridge or a large magnum cartridge. Cases with different levels of performance have long been sought in the industry.

SUMMARY

A firearm cartridge case according to one disclosed non-limiting embodiment of the present disclosure includes a cartridge case having a base which defines a cartridge case diameter; and a rebated rim which defines a rim diameter less than the cartridge case diameter, a ratio of the cartridge case diameter to the rim diameter is between 1.03-1.10.

A further embodiment of any of the foregoing embodiments of the present disclosure includes that a ratio of the cartridge case diameter to the rim diameter is 1.06.

A further embodiment of any of the foregoing embodiments of the present disclosure includes that the cartridge case diameter is 0.497 inches measured at a location which is 0.150 inches from the base.

A further embodiment of any of the foregoing embodiments of the present disclosure includes that the rim diameter is 0.471 inches.

A further embodiment of any of the foregoing embodiments of the present disclosure includes that the cartridge case diameter is 0.497 inches measured at a location which is 0.150 inches from the base and the rim diameter is 0.471 inches.

A further embodiment of any of the foregoing embodiments of the present disclosure includes that the cartridge case is a short action case.

A further embodiment of any of the foregoing embodiments of the present disclosure includes that the cartridge case is 1.92 to 2.10 inches in length.

A further embodiment of any of the foregoing embodiments of the present disclosure includes that a ratio of the overall case length and the cartridge case diameter is 3.8-4.2.

A further embodiment of any of the foregoing embodiments of the present disclosure includes that a ratio of the overall case length and the cartridge case diameter is 4.0.

A further embodiment of any of the foregoing embodiments of the present disclosure includes a small primer pocket within the base of the cartridge case.

A further embodiment of any of the foregoing embodiments of the present disclosure includes that the cartridge case has a capacity to contain 45-55 grains of gun powder within the cartridge case.

A firearm cartridge according to one disclosed non-limiting embodiment of the present disclosure includes a cartridge case with a rebated rim which defines a rim diameter less than a cartridge case diameter of the cartridge case; a small rifle primer inserted within a primer pocket formed in the cartridge case; and a projectile inserted at least partially within a mouth of the cartridge case to form a cartridge case overall length that is less than 2.8 inches.

A further embodiment of any of the foregoing embodiments of the present disclosure includes 45-55 grains of gun powder within the cartridge case.

A further embodiment of any of the foregoing embodiments of the present disclosure includes that the projectile is between 0.22-0.30 caliber.

A further embodiment of any of the foregoing embodiments of the present disclosure includes that a ratio of the cartridge case diameter to the rim diameter is 1.06.

A further embodiment of any of the foregoing embodiments of the present disclosure includes that a ratio of the overall case length and the cartridge case diameter is 3.8-4.2.

A further embodiment of any of the foregoing embodiments of the present disclosure includes that a ratio of the overall case length and the cartridge case diameter is 4.0.

A further embodiment of any of the foregoing embodiments of the present disclosure includes that the cartridge case diameter is 0.497 inches measured at a location which is 0.150 inches from the base and the rim diameter is 0.471 inches.

A further embodiment of any of the foregoing embodiments of the present disclosure includes that the cartridge case is 2.035 inches in length.

A further embodiment of any of the foregoing embodiments of the present disclosure includes that a 0.420 headspace gauge is at 1.656+/−0.003 inches for the cartridge case.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
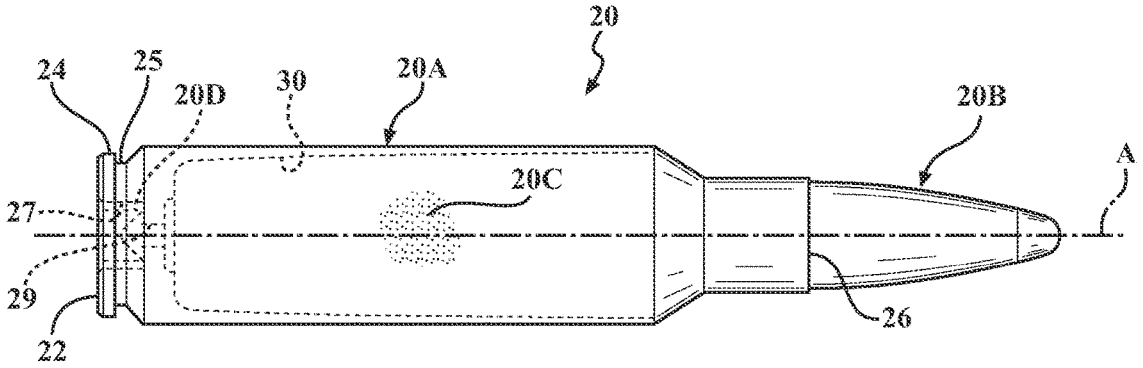
FIG. 1 is a side view of an exemplary embodiment of a cartridge according to one disclosed non-limiting embodiment.

FIG. 1 schematically illustrates a firearm cartridge 20 that has an elongated bottle shaped case 20A capable of withstanding internal gas pressures of about 53,000 CUP, or 65,000 psi. In a firearm chamber, propellant burns over a period of time which produces increased pressure until it reaches a peak, then the pressure decreases until the projectile exits the muzzle wherein any remaining pressure does not contribute to projectile velocity. Cartridge performance is typically limited by a maximum allowable peak internal pressure in the chamber of the firearm.

The cartridge case 20A has a head end defining a substantially circular base 22 with an annular rim 24 adjacent to an extractor groove 25. In this embodiment, the annular rim 24 may be 0.049 inches thick and the extractor groove 25 may be 0.045 inches thick. An open end opposite the base 22 defines a mouth 26 to receive a projectile 20B. In this embodiment, a 0.420 headspace gauge is at 1.656+/−0.003 inches.

The base 22 includes a centrally located primer pocket 27 that communicates via a flash hole 29 with an interior 30 of the cartridge case 20A in which the powder charge 20C (illustrated schematically) is contained. In this embodiment, the primer pocket 27 receives a small rifle primer 20D (illustrated schematically).

Figure 2:
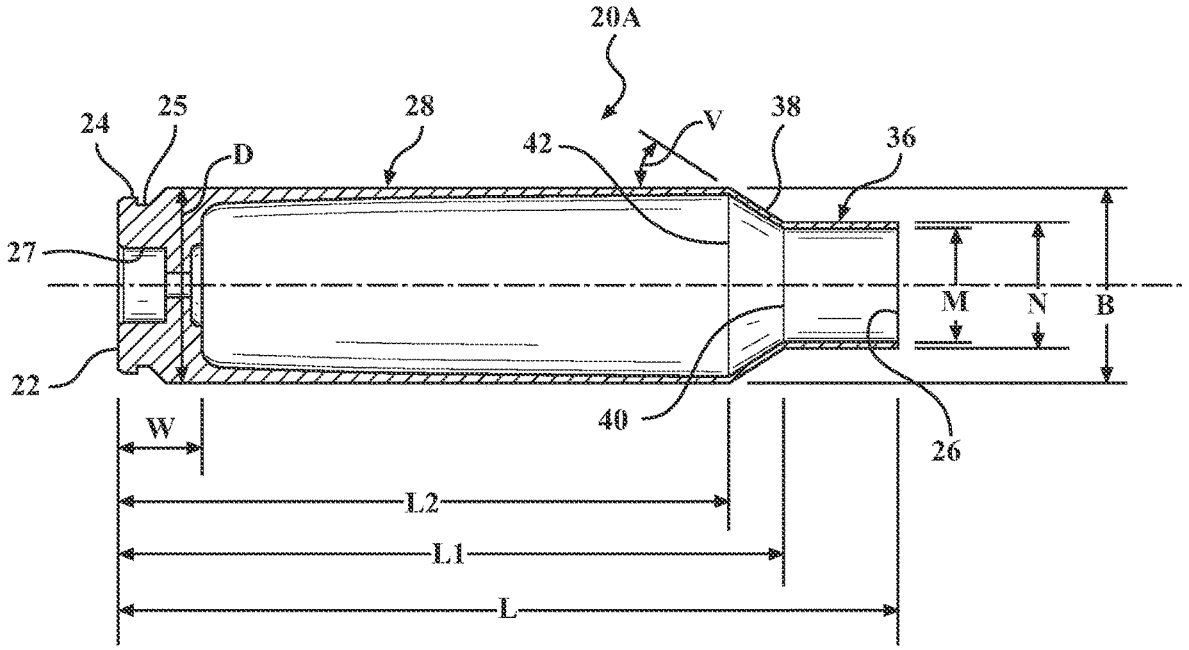
FIG. 2 is a side view of a cartridge case of the cartridge in FIG. 1.

With reference to FIG. 2, the cartridge case 20A includes a main body portion 28 that extends forward from the extractor grove 25 toward the mouth 26, and a relatively smaller neck portion 36 that are interconnected by a frusto-conical shoulder portion 38 to form the bottleneck shaped cartridge case. The main body portion 28 and the smaller diameter neck portion 36 may not be perfectly cylindrical, but may be rather slightly frusto-conical, narrowing slightly in a direction away from the base 22.

The frusto-conical shoulder portion 38 extends at an angle V with respect to the axis A of the cartridge 20. In one embodiment, the angle V is 30 degrees.

The extractor groove 25 is formed at the rear of the main body portion 28 and has a diameter smaller than that of the rim 24 and the main body portion 28. The extractor groove forms a surface upon which an extractor engages the cartridge case 20A to facilitate ejection of the cartridge case 20A from the firearm. The extractor groove 25 is typically only present on a cartridge that is considered a rimless cartridge. In this embodiment, the rim 24 is a rebated rim. A rebated rim cartridge has a rim that is smaller in diameter than the base of the cartridge case, serving only for extraction purposes. Functionally essentially the same as a rimless case, the rebated rim provides some additional benefits when considered in conjunction with other cartridges such as allowing a firearm to be converted to fire a larger-than-normal cartridge, as most of a firearms' action (loading/extraction mechanism) need not be altered so long as the rim size is preserved.

Figure 3:
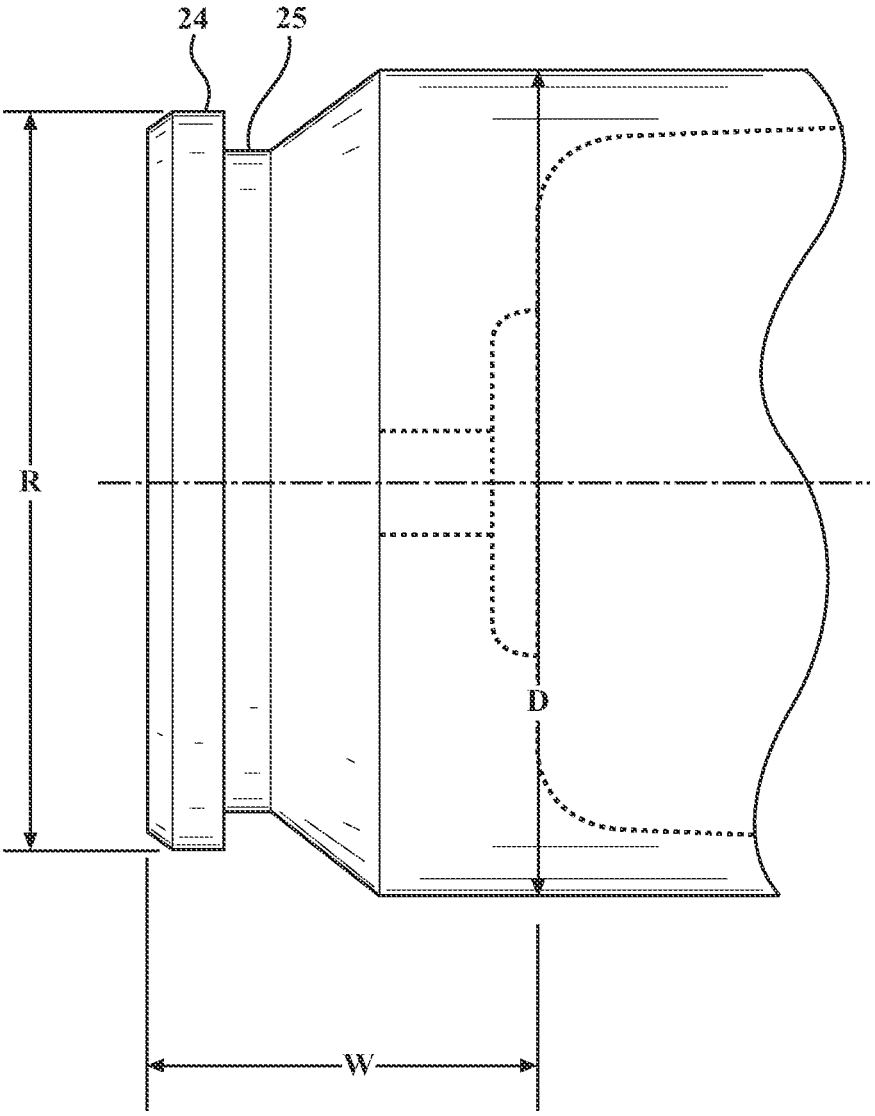
FIG. 3 is an expanded side view of the head end of the cartridge case of the cartridge in FIG. 1.

In this embodiment, the rim 24 may have a diameter of 0.471 inches, the extractor groove 25 may have a diameter of 0.407 inches, and the main body portion 28 may have a cartridge case diameter, designated as D, of 0.497 inches. For purposes of that disclosed herein, the cartridge case diameter D of the main body portion 28 of the cartridge case 20A is measured at a location W (also shown in FIG. 3) which is 0.150 inches from the base 22, so as to identify such outer diameter precisely despite the slightly frusto-conical shape of the main body portion 28. In one embodiment, a ratio of the cartridge case diameter D to the rim diameter R is between 1.03-1.10 and more specifically is 1.06. In contrast, a standard case may have a rim and a bolt end of the body with a diameter of 0.471 inches and a magnum case may have a rim with a diameter of 0.538 inches and a bolt end of the body with a diameter of 0.550 inches which is ratio of the cartridge case diameter to the rim diameter of 1.03.

The overall length of the cartridge case 20A, designated as L, extends between the base 22 at the head end of the cartridge case 20A and the mouth 26 at the open end of the cartridge case 20A. According to one disclosed embodiment, the overall length of the cartridge case 20A, designated as L, is 1.92 to 2.10 inches, and more specifically 2.035 inches. To maximize the powder-carrying capacity of the cartridge case 20A in a manner which nevertheless produces a cartridge short enough to be used in a short-action firearm, the ratio of the overall case length L over such diameter D (i.e., L/D) should be no more than about 3.8-4.2, and more specifically 4.0.

The mouth 26 is the opening at the most forward part of the cartridge case 20A within which the projectile 20B is seated. The projectile 20B may be configured in many different sizes and shapes. Therefore, the determination of the configuration for the projectile may be based on many different individual factors and is not a factor to the proposed invention. In this embodiment, the cartridge case 20A includes a mouth diameter M that is 0.255 inches in diameter with a thickness of 0.015. In this embodiment, the cartridge case 20A includes a neck interface diameter N that is 0.285 inches in diameter at an interface 40 between the neck portion 36 and the frusto-conical shoulder portion 38. In this embodiment, the cartridge case 20A also includes a body interface diameter B that is 0.482 inches in diameter at an interface 42 of the frusto-conical shoulder portion 38 and the main body portion 28.

According to one disclosed embodiment, a length L1 of the cartridge case 20A, between the base 22 and the interface 40 is 1.770 inches and the length L2 of the cartridge case 20 between the base 22 and the interface 42 is 1.602 inches.

Commonly, there is approximately a 0.5 inch difference in cartridge length between a short action cartridge and a long action cartridge. That difference may be smaller when considering just the cartridge case rather than the entire cartridge. For example, a short action cartridge might have a cartridge case with a length of 2.05-2.10 inches whereas a long action cartridge might have a cartridge case with a length greater than 2.1 inches. A long action case is larger than a short action case, so more powder propellant may be contained in a long action case compared to a short action case. For example, a short action standard case may have 28 to 44 grains of gun powder. A short action magnum case may have 55 to 70 grains of gun powder. A long action standard case may have 55 to 67 grains of gun powder. A long action magnum case may have 55 to 67 grains of gun powder. This leaves a gap in grain count from 45 to 55 and therefore a gap in performance. The described amounts of gun powder may be most relevant to calibers from 22 caliber to 30 caliber. The cartridge case 20A increase the propellant burn efficiency and uniformity with the end result being higher muzzle velocity with its attendant down-range advantages of reduced projectile drop, reduced wind deflection, and higher impact energy, etc. and increased shot-to-shot pressure/velocity consistency offering the potential for improved accuracy.

According to one disclosed embodiment, the cartridge case 20A does not have a radially protruding belt on the outside of the cartridge case such as that often utilized on a magnum cartridge. Magnum cases are cases that allow for a greater amount of propellant powder in comparison to what is considered a standard case. A magnum case may also have a cartridge case head with a greater diameter than a standard case. Given that a standard case is smaller in size relative to a magnum case, the amount of powder propellant which can be contained in a magnum case is greater than the amount of powder propellant which can be contained in a standard case, however, adding a belt as typical in a magnum case would require reductions in its diameter and capacity to make it compatible with a standard short action magazine. In addition, a belt would increase the difficulties attendant to chambering the cartridges and reduce cartridge capacity for a short action.

The cartridge case 20A provides for a short action cartridge with a rebated rim, is not a magnum, and has a higher powder capacity than a standard case. Rebated rims heretofore have not been used in short action cases. The cartridge case 20A allows for a cartridge with lower recoil, short action, and higher performance compared to a standard cartridge. The cartridge case 20A as disclosed herein utilizes a short action case and a rebated rim. This unique combination allows for a greater amount of propellant powder to be contained in the cartridge case while not requiring the cartridge case to be a long action case. Long action cases are not usable in firearms that are designed to be used with short action cases.

The cartridge case 20A advantageously bridges a gap in performance determined by applicant, that has not been previously identified. Traditionally, the industry has focused on projectile innovation rather than case innovation. Projectile innovation has included high ballistic coefficient projectiles that are heavy for their respective caliber grain weight. The cartridge case 20A as disclosed herein, further creates a performance window for high ballistic coefficient projectiles from a short action non-magnum case with greater propellent powder capacity.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason, the appended claims should be studied to determine true scope and content.

What is claimed is:

1. A firearm cartridge case, comprising:

a short action cartridge case comprises a cartridge case main body portion and a cartridge case neck portion that are interconnected by a frusto-conical shoulder portion to form a bottleneck shape; and a rebated rim which defines a cartridge case rim diameter less than the cartridge case main body portion diameter, a ratio of the cartridge case main body portion diameter to the rim diameter is between 1.03-1.10.

2. The firearm cartridge case as recited in claim 1, wherein a ratio of the cartridge case main body portion diameter to the rim diameter is 1.06.

3. The firearm cartridge case as recited in claim 1, wherein the cartridge case main body portion diameter is 0.497 inches measured at a location which is 0.150 inches from the base.

4. The firearm cartridge case as recited in claim 1, wherein the rim diameter is 0.471 inches.

5. The firearm cartridge case as recited in claim 1, wherein the cartridge case main body portion diameter is 0.497 inches measured at a location which is 0.150 inches from the base and the rim diameter is 0.471 inches.

6. The firearm cartridge case as recited in claim 1, wherein the cartridge case is 1.92 to 2.10 inches in length.

7. The firearm cartridge case as recited in claim 1, wherein a ratio of the overall case length and the cartridge case main body portion diameter is 3.8-4.2.

8. The firearm cartridge case as recited in claim 1, wherein a ratio of the overall case length and the cartridge case main body portion diameter is 4.0.

9. The firearm cartridge case as recited in claim 1, further comprising a small primer pocket within the base of the cartridge case.

10. The firearm cartridge case as recited in claim 1, wherein the cartridge case has a capacity to contain 45-55 grains of gun powder within the cartridge case.

11. A firearm cartridge, comprising:

a short action cartridge case comprising a cartridge case main body portion and a cartridge case neck portion that are interconnected by a frusto-conical shoulder portion to form a bottleneck shape, a rebated rim which defines a cartridge case rim diameter less than a cartridge case diameter, wherein a ratio of the cartridge case main body portion diameter to the cartridge case rim diameter is between 1.03-1.10, and a ratio of an overall short action cartridge case length and the cartridge case main body portion diameter is 3.8-4.2;

45-55 grains of gun powder within the short action cartridge case;

a small rifle primer within a primer pocket formed in the cartridge case; and a projectile at least partially within a mouth of the cartridge case neck portion to form a cartridge overall length that is less than 2.8 inches, wherein the projectile is between 0.22-0.30 caliber.

12. The firearm cartridge case as recited in claim 11, wherein a ratio of the cartridge case main body portion diameter to the rim diameter is 1.06.

13. The firearm cartridge case as recited in claim 12, wherein a ratio of the overall case length and the cartridge case main body portion diameter is 4.0.

14. The firearm cartridge case as recited in claim 12, wherein the cartridge case main body portion diameter is 0.497 inches measured at a location which is 0.150 inches from the base and the rim diameter is 0.471 inches.

15. The firearm cartridge case as recited in claim 1, wherein the cartridge case is 2.035 inches in length.

16. The firearm cartridge case as recited in claim 1, wherein a 0.420 headspace gauge is at 1.656+/−0.003 inches for the cartridge case.

17. The firearm cartridge case as recited in claim 1, wherein the main body portion extends forward from an extractor grove to the frusto-conical shoulder.

18. The firearm cartridge case as recited in claim 17, wherein the cartridge case main body portion diameter is 0.497 inches measured at a location which is 0.150 inches from the base.

19. The firearm cartridge case as recited in claim 17, wherein the cartridge case main body portion diameter is 0.497 inches measured at a location which is 0.150 inches from the base and the rim diameter is 0.471 inches.

20. The firearm cartridge case as recited in claim 19, wherein the short action cartridge case is 1.92 to 2.10 inches in length.

21. The firearm cartridge case as recited in claim 1, wherein a ratio of the cartridge case main body portion diameter to the cartridge case rim diameter is between 1.03-1.10.

22. The firearm cartridge case as recited in claim 1, wherein a length of the cartridge case between a base and an interface between the frusto-conical shoulder portion and the cartridge case neck portion is 1.770 inches and the length of the cartridge case between the base and an interface between the frusto-conical shoulder portion and the cartridge case main body portion is 1.602 inches.

23. The firearm cartridge case as recited in claim 22, wherein an angle defined by the frusto-conical shoulder portion is 30 degrees.

24. A firearm cartridge case, comprising:

a short action cartridge case comprises a cartridge case main body portion and a cartridge case neck portion that are interconnected by a frusto-conical shoulder portion to form a bottleneck shape; and a rebated rim which defines a cartridge case rim diameter that is 0.471 inches, wherein the cartridge case main body portion diameter is 0.497 inches measured at a location which is 0.150 inches from the base, a length of the cartridge case between the base and an interface between the frusto-conical shoulder portion and the cartridge case neck portion is 1.770 inches and the length of the cartridge case between the base and an interface between the frusto-conical shoulder portion and the cartridge case main body portion is 1.602 inches, a ratio of the cartridge case main body portion diameter to the cartridge case rim diameter is between 1.03-1.10, and a ratio of an overall short action cartridge case length and the cartridge case main body portion diameter is 3.8-4.2.

* * * * *